United States Patent [19]

Beny et al.

[11] 4,089,135

[45] May 16, 1978

[54] SLIDING DOOR ASSEMBLY

[76] Inventors: Janos Beny, 202 Calle de Sirenos, Redondo Beach, Calif. 90277; Daniel H. Meggs, 4313 Vista Largo, Torrance, Calif. 90505

[21] Appl. No.: 728,255

[22] Filed: Sep. 30, 1976

Related U.S. Application Data

[63] Continuation-in-part of Ser. No. 492,517, Jul. 29, 1974, Pat. No. 3,990,183.

[51] Int. Cl.[2] ..... E05D 15/58

[52] U.S. Cl. ..... 49/257; 49/260; 49/425

[58] Field of Search ..... 49/254, 425, 427, 257, 49/260, 125, 127; 16/95 R, 97, 98, 96 R, 96 L

[56] References Cited

U.S. PATENT DOCUMENTS

| | | | |
|---|---|---|---|
| 1,188,482 | 6/1916 | Phillips | 49/257 X |
| 1,809,093 | 6/1931 | Willard | 49/257 X |
| 2,766,857 | 10/1956 | Miller | 49/411 |
| 3,063,496 | 11/1962 | Kessler | 49/257 X |
| 3,235,915 | 2/1966 | Glaser | 49/127 X |
| 3,309,816 | 3/1967 | Malone, Jr. | 49/411 X |
| 3,397,487 | 8/1968 | Hunt et al. | 49/425 X |
| 3,744,827 | 7/1973 | Cox | 49/411 X |

*Primary Examiner*—Philip C. Kannan

[57] ABSTRACT

Doors are slideably mounted in tracks by structure which cooperates with and follows the course of the tracks even around sharp corners and curves to permit sliding of the doors into out of the way storage positions. The sliding door assembly is illustrated forming a bathtub/shower enclosure.

3 Claims, 4 Drawing Figures

SLIDING DOOR ASSEMBLY

REFERENCE TO PRIOR APPLICATION

This application is considered to be a continuation in part of Patent Application Ser. No. 492,517 filed July 29, 1974, by Daniel H. Meggs and Janos Beny now U.S. Pat. No. 3,990,183.

BACKGROUND OF THE INVENTION

The present invention relates to doors and more particularly sliding door assemblies.

SUMMARY OF THE INVENTION

It is an object of the present invention to provide an improved sliding door assembly characterized by being arranged to permit the sliding of its doors into out of the way storage positions to facilitate cleaning and easy access to the area closed off by the doors.

It is further an object of the present invention to provide an improved door assembly as set forth characterized by having its doors slideably mounted by pivotal rollers which cooperate with and follow the course of the tracks even around sharp corners and curves to permit the sliding of the doors into the out of the way storage positions.

It is additionally an object of the present invention to provide an improved pivotal roller assembly for slideably mounting doors.

Subject matter of this invention is directed to a sliding door assembly in which the door is slideably mounted within a track by means of a pivotal roller assembly. The roller is pivotally mounted to only one leg of a bifurcated member, the apex of the bifurcated member being connected to a shank which is pivotally mounted upon the door. The other leg of the bifurcated member acts as a guide for the movement of the roller and this other leg extends exteriorly of the track.

DETAILED DESCRIPTION OF THE PREFERRED EMBODIMENT

Figure 1:
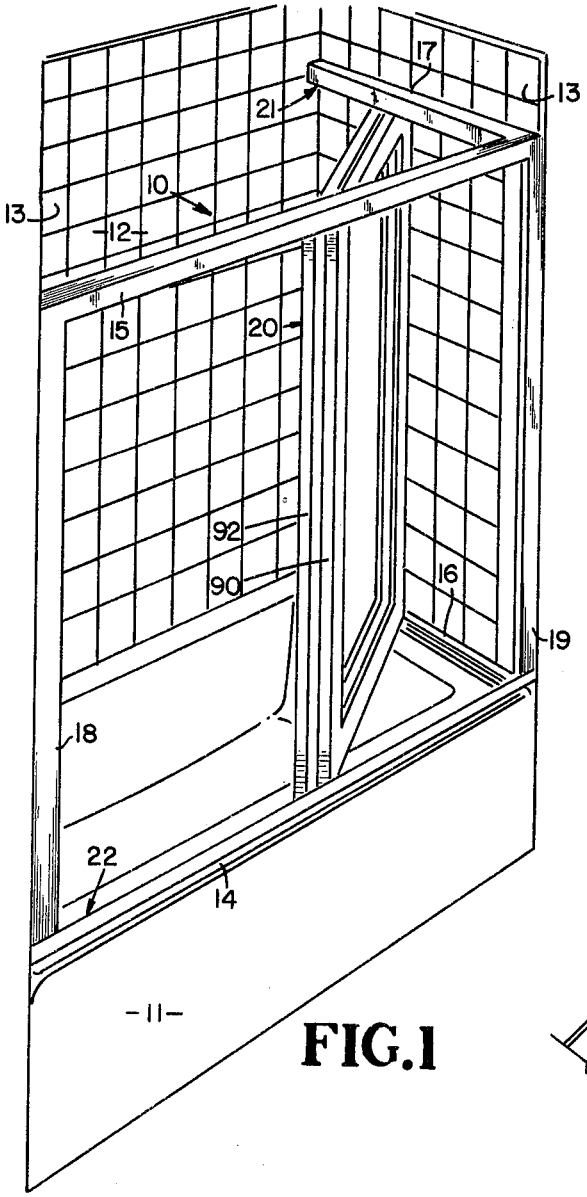
FIG. 1 is a perspective view of a sliding door assembly according to the present invention illustrated forming a bathtub/shower enclosure.

Referring to the drawings in more detail, there is shown in FIG. 1 a sliding door assembly generally identified by the number 10 mounted to form a bathtub/-shower enclosure.

The bathtub/shower is formed by a tub 11 positioned in a stall or recess defined by vertical back wall 12 and vertical side walls 13.

Frame structure for supporting the sliding door assembly 10 is provided by horizontal extending frame members 14, 15, 16, 17 and vertical extending frame members 18, 19.

The sliding door assembly 10 illustrated in FIG. 1 is formed by a pair of doors 20 slideably mounted in a pair of substantially parallel horizontally extending upper and lower tracks 21 and 22, respectively.

Figure 2:
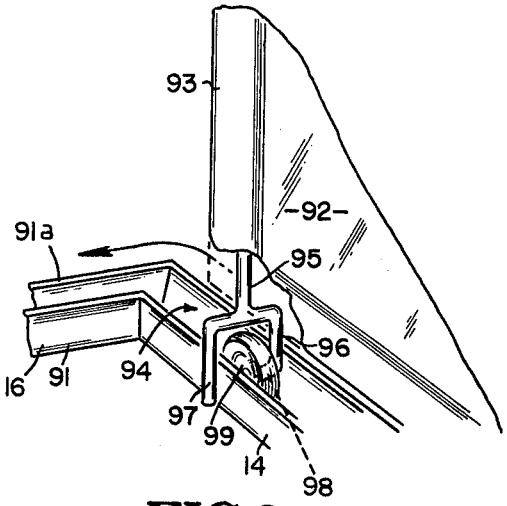
FIG. 2 is a perspective view of the roller assembly which is employed to slideably mount the door assembly of this invention upon cooperating track means.
Figure 3:
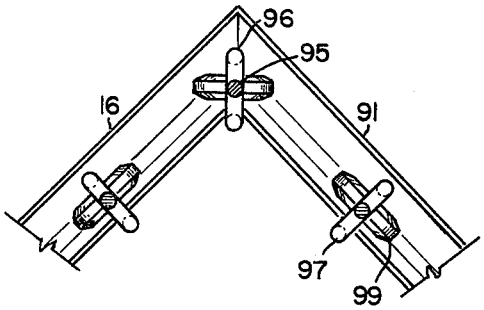
FIG. 3 is a top plan view showing the operation of the roller assembly of this invention depicting the movement of the roller assembly about a right angled corner of the track.
Figure 4:
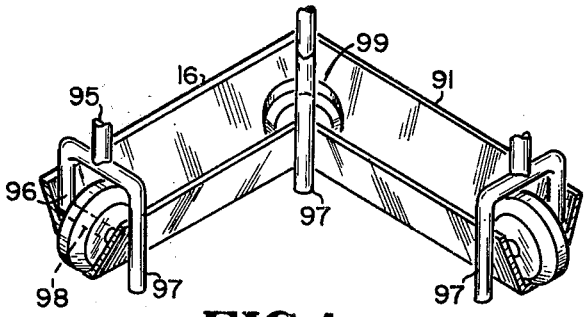
FIG. 4 is a perspective view of the structure shown in FIG. 3.

The pair of doors 20 are mounted for movement in conjunction with each other but are to be moved separately. The doors are to assume the position against the forward end of the shower/tub enclosure which will be assumed to be the out of way or stowage position or can assume a position completely blocking the access opening to the enclosure. The pair of doors 20 comprises separate doors 90 and 92. Reference is to be had to FIG. 2 wherein door 92 is shown. Each of the doors comprises a top edge and a bottom edge which are interconnected by vertical sides. A pair of roller assemblies such as roller assembly 94 are mounted on the top edge of each door as well as on the bottom edge of each door. Each roller assembly is located adjacent the vertical side. Each of the roller assemblies are identical and it is only necessary to describe one such roller assembly as that description will suffice for all roller assemblies.

Referring particularly to FIG. 2, the door 92 is illustrated slideably mounted within a lower track 91 which is formed as part of the frames 14 and 16. The slideable movement is provided by a pivotal roller assembly 94. The roller assembly 94 includes a downwardly extending shank 95 which is pivotally mounted to extend from the lower edge of the door side portion 93. Formed on the lower end of the shank 95 is a downwardly extending fork (bifurcated member) which forms a crank arm 97 and an arm 96 for carrying roller wheel 99. The arm 96 has a horizontal extension 98 on its lower end thereof which provides an axle for the wheel 99.

The wheel 99 is shown positioned to ride in the V-shaped channel **91*a* defined by track 91. In operation the door 92 is slid toward the corner in the track 91, the wheel 99 rotates in the track 91*a*. When the roller assembly 94 reaches the corner of the track 91, the crank 97 engages the exterior side wall of the track 91 with the result the roller assembly pivots about its vertical axis defined by the shank 95 to rotate the wheel 99 around the corner of the track 91. It is to be understood that the wheel 99 and the arm 96 is located within the confines of the V-shaped channel 91*a* whereas the crank 97 is always located exteriorly of the track 91**.

It is noted that while the subject matter of this invention was illustrated in forming a bathtub/shower enclosure, that sliding door assemblies in accordance therewith may be used for cabinet, wardrobe or any other doors where space saving is desired or required such as mobile homes, campers or the like.

We claim:

1. Sliding Door Assembly comprising:

a door having an upper edge and a lower edge interconnected by vertical side edges;

upper and lower tracks each being mounted vertically one above the other, said upper and lower tracks spaced apart at a selected distance greater than the height of said door so that said door may be positioned therebetween, said lower track including a channel, an inner side and an outer side, and;

means mounted on said upper and lower edges of said door which cooperates with and follows said tracks to permit sliding of said door around corners and curves of said tracks, said means mounting said door on said lower track including a pair of horizontally spaced apart rotatably mounted wheels which rotate within said tracks to roll therealong and be pivotal about a substantially vertical axis with respect to said door, said means includes crank arms which is adapted to be positioned to extend downwardly on the inner side of said tracks and is adapted to strike the inner radius of said inner side of said track whenever said wheels reach a corner, whereby the force of said tracks against said crank arm causes said wheels to pivot with respect to said door thereby aiding the movement of said wheels around a corner in said tracks.

2. The sliding door assembly as defined in claim 1, wherein:

the pivoting axis of said roller assembly with respect to said door lying within the plane of rotation of said wheel.

3. The sliding door assembly as defined in claim 2, wherein:

said track comprising a substantially V-shaped channel for aligning said wheel within the center of said track.

* * * * *